US006502277B1

(12) United States Patent
Petersson et al.

(10) Patent No.: US 6,502,277 B1
(45) **Date of Patent: *Jan. 7, 2003**

(54) EMPTYING DEVICE FOR A CYCLONE VACUUM CLEANER

(75) Inventors: Stefan Petersson; Patrik Pastuhoff, both of Västervik (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/545,356

(22) Filed: Apr. 7, 2000

(30) Foreign Application Priority Data

Apr. 8, 1999 (SE) ..... 9901252

(51) Int. Cl.[7] ..... A47L 9/16

(52) U.S. Cl. ..... 15/352; 15/353; 55/337; 55/DIG. 3

(58) Field of Search ..... 15/352, 353, 327.7; 55/337, DIG. 3

(56) References Cited

U.S. PATENT DOCUMENTS

| | | | | |
|---|---|---|---|---|
| 4,426,211 | * | 1/1984 | Ataka et al. | 15/352 |
| 5,090,976 | * | 2/1992 | Dyson | 55/337 |
| 5,145,499 | * | 9/1992 | Dyson | 55/337 |
| 5,779,745 | * | 7/1998 | Kilström | 55/337 |
| 5,935,279 | * | 8/1999 | Kilström | 55/337 |
| 6,168,641 | * | 1/2001 | Tuvin et al. | 55/337 |

* cited by examiner

*Primary Examiner*—Theresa T. Snider
(74) *Attorney, Agent, or Firm*—Pearne & Gordon LLP

(57) ABSTRACT

A vacuum cleaner assembly including a vacuum cleaner housing (10) and an air filtration unit removably installed in the housing. The unit includes a coarse separator (25), a cyclone with a cyclone chamber (26), a collecting container (27), and a releasable cover plate (37). The coarse separator (25) receives dirt-laden air. Air is tangentially introduced into the cyclone chamber (26), which is downstream the coarse separator (25). The collecting chamber (27) receives particles separated from the air stream in the cyclone chamber (26). The cover plate (37) serves as a wall part for each of the coarse separator, cyclone, and collecting container whereby, after the unit (14) has been removed from the housing (10), the cover plate is removed to simultaneously reveal the coarse separator, cyclone, and collecting container to permit emptying thereof.

10 Claims, 5 Drawing Sheets

EMPTYING DEVICE FOR A CYCLONE VACUUM CLEANER

BACKGROUND OF THE INVENTION

The present invention generally relates to a vacuum cleaner housing having a coarse separator into which dust laden air is drawn by means of a vacuum source from a nozzle connected to the vacuum cleaner, a cyclone with a cyclone chamber arranged after the coarse separator as seen in the flow direction, and a collecting container for particles separated by the cyclone.

Vacuum cleaners of the type mentioned above are previously known, see for instance U.S. Pat. No. 5,779,745. In these vacuum cleaners the lower part of the coarse separator and the cyclone each constitute a collecting container that can be emptied via an opening in each container. The openings are covered by a common lid. A disadvantage with this arrangement is that it is difficult to clean the coarse separator, the cyclone and the other air channels unless extensive disassembly is carried out. Disassembly of the machine is dirty and unhygienic.

It is also previously known, see GB 2321181, in a similar arrangement to empty the two integrated collecting containers by removing the container part from the vacuum cleaner and turning the container part up-side-down, which means that a grating covering the coarse separator is opened and that the contents of the cyclone falls out through a separate emptying opening. The liner may also be manually removed from the cyclone before the container is turned right-side-up. With this arrangement it is also cumbersome and unhygienic to empty and clean the containers.

It is also previously known in vacuum cleaners having two concentric cyclones that are connected in series, see for instance EP 636338, to use an arrangement having two containers being separated by means of a liner that is manually removed during emptying. Also, in this case, an extensive unhygienic disassembly operation is required in order to clean the two cyclones and the gratings and container walls belonging to them.

SUMMARY OF THE INVENTION

The present invention is directed toward an emptying system for a cyclone vacuum cleaner in which the emptying is simplified and more hygienic to undertake than in previously-known systems. The present invention is further directed toward a cyclone vacuum cleaner wherein all the parts of the cyclone system are uncovered during emptying, thereby rendering all the internal surfaces of the cyclone, the container and the coarse separator accessible for cleaning.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
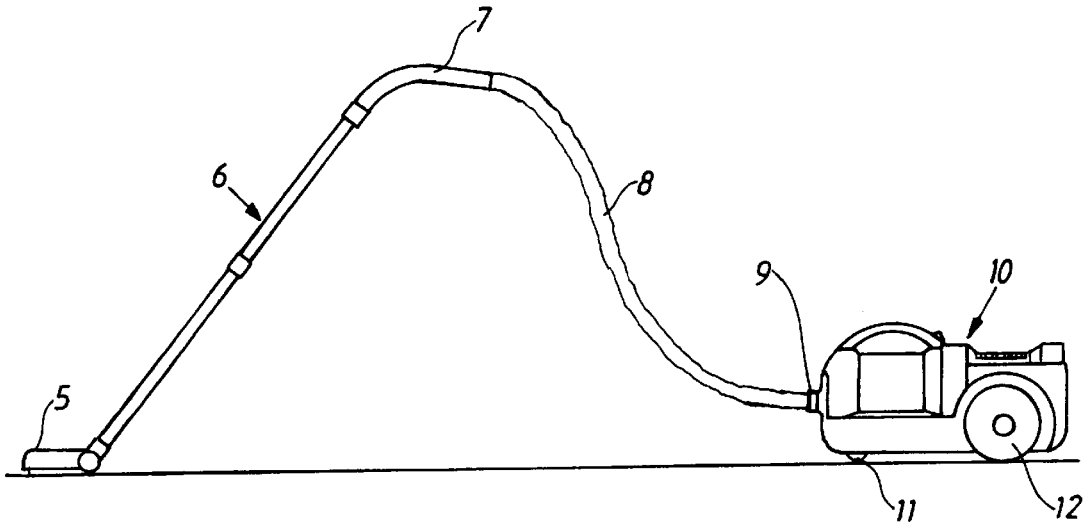
FIG. 1 schematically shows a vacuum cleaner with accessories.

With reference to FIG. 1, a vacuum cleaner has a nozzle 5 connected to a tube shaft 6 that, via a tube handle 7 and a hose 8 with a hose connection 9, is secured to a vacuum cleaner housing 10. The vacuum cleaner housing 10 is supported by a front pivot wheel 11 and two rear wheels 12.

Figure 2:
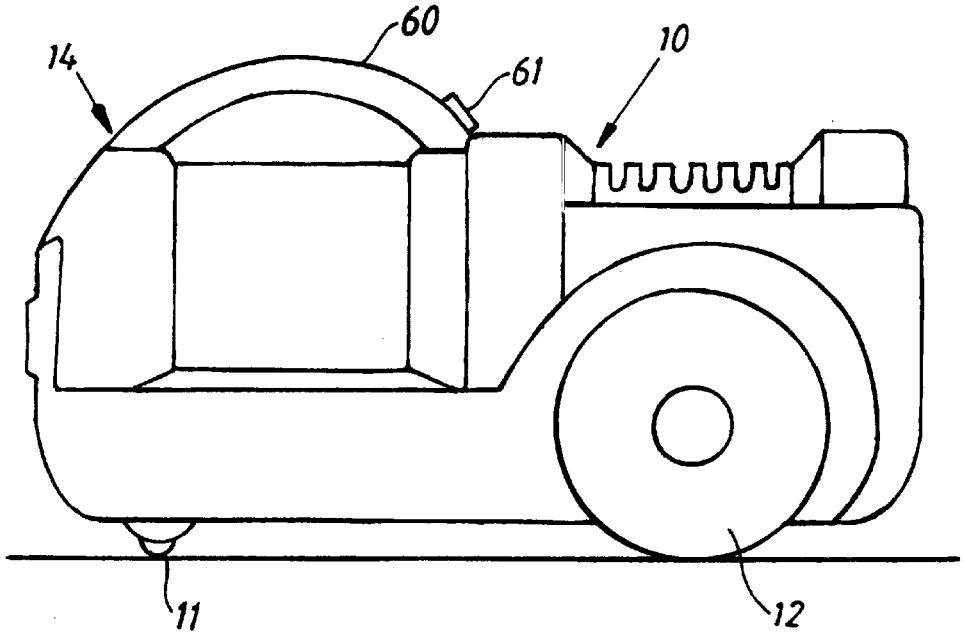
FIG. 2 is a side view of the vacuum cleaner according to the invention being provided with a liner.
Figure 3:
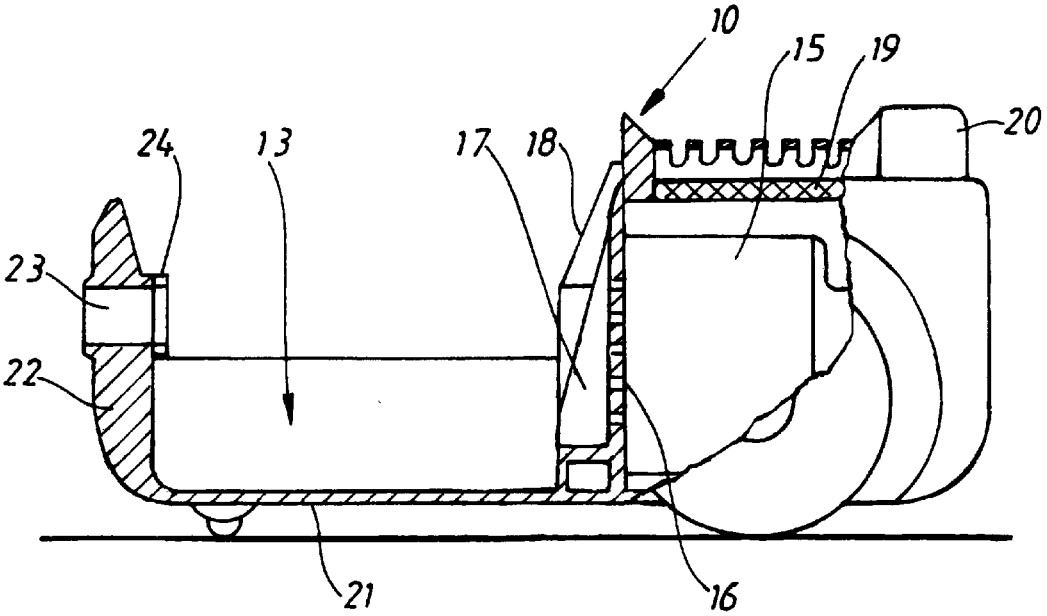
FIG. 3 is a vertical section of the vacuum cleaner shown in FIG. 2, but with the liner removed.

With reference to FIGS. 2–3, the housing 10 defines a recess 13 in which a liner 14 is removably secured. The vacuum cleaner housing 10, in a traditional manner, encloses a vacuum source such as a fan unit 15. The fan unit 15 has an inlet side that, via openings 16, is connected to an air inlet part 17. The air inlet part 17 is surrounded by an inclined, angled sealing surface 18 on which the liner 14 rests. The vacuum cleaner housing 10 also includes a replaceable outlet filter 19, through which the outlet air from the fan unit 15 leaves to atmosphere, and control means 20, other electric means, a cable reel, and other conventional features.

The vacuum cleaner housing 10 has a front end wall 22 extending upwardly from a bottom wall 21 of the housing, the bottom wall 21 defining a lower limit of the recess 13. The front wall 22 is provided with a through-tube section 23 to which the hose connection 9 can be secured. The side of the tube section 23 facing the recess is provided with an annular sealing 24 in order to seal against the liner 14.

With reference to FIGS. 4–7, the liner 14 includes three elongated, horizontal, parallel chambers that are separated from one another. These three chambers are referred to hereinafter as a coarse separator 25, a cyclone with a cyclone chamber 26, and a collecting container 27.

Figure 4:
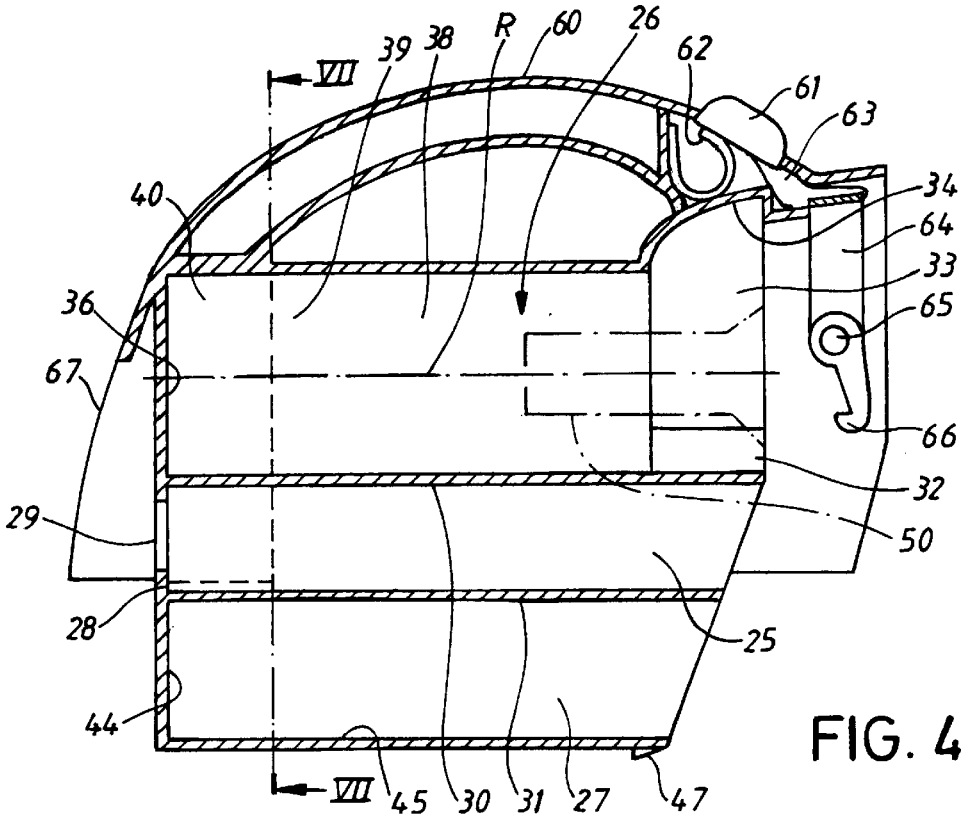
FIG. 4 is a vertical section through the liner with a cover plate, which serves as an end wall, removed.
Figure 6:
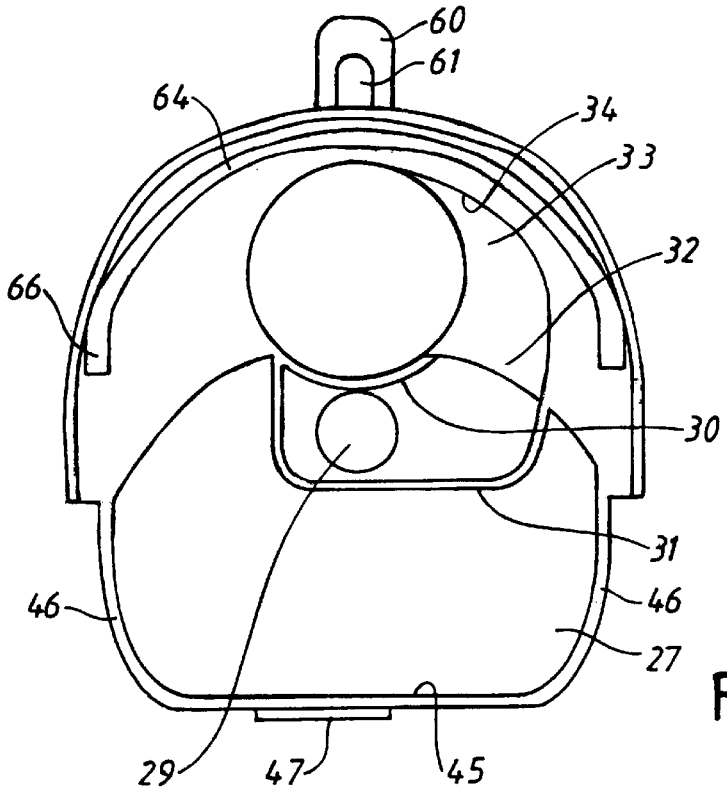
FIG. 6 is the same end view as that of FIG. 5, but with the cover plate removed.

The coarse separator 25 has an end wall 28 with an inlet opening 29 that, when the liner 14 is placed in the vacuum cleaner housing 10, is coaxial with the tube section 23. The coarse separator 25 is surrounded by a first wall part 30, which serves as a separating wall toward the cyclone chamber 26, and a second wall part 31, which serves as a separating wall toward the collecting container 27. At the end of the coarse separator 25 remote from the end wall 28, there is an opening 32 in the first wall part 30 (FIGS. 4 and 6). The opening 32 continues into an inlet channel 33 to the cyclone chamber 26, the channel 33 being arranged near one end of the cyclone chamber 26. One wall 34 of the inlet channel 33 is curved and arranged such that a mainly tangentially-directed air inlet flow is created in the cylinder-shaped cyclone chamber 26.

The cyclone chamber 26 is provided with a first end wall 35 and a second end wall 36. The first end wall 35 is a part of a cover plate 37, which will be more fully discussed hereinafter. The cyclone chamber 26 is also provided with an intermediate part 38 that is disposed between the end walls 35, 36. Preferably, the intermediate part 38 is either cylinder-shaped or is shaped as a truncated cone directed such that the smaller cone opening faces the second end wall 36. The intermediate part 38 has an opening 39 (whose diameter in the embodiment shown in FIG. 4 is identical to a diameter of the intermediate part 38) that leads to a separation part 40 positioned close to the second end wall 36.

Figure 7:
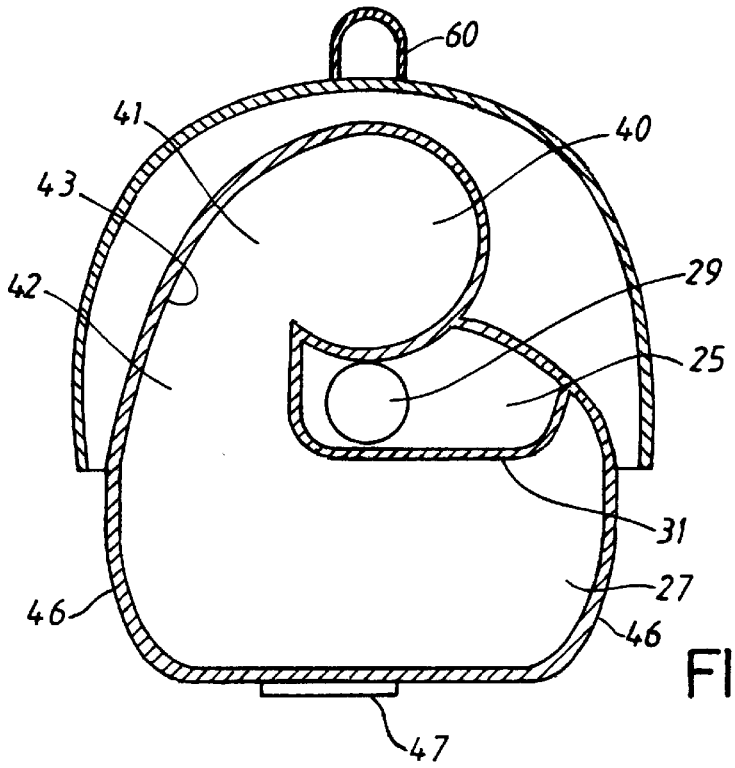
FIG. 7 is a cross-sectional view as seen along line VII—VII in FIG. 4.

With reference to FIGS. 4 and 7, the separation part 40 has an opening 41 in the side wall. The opening 41 extends almost over the complete length of the separation part 40 and is connected to a channel 42 leading to the collecting container 27. One wall 43 of the channel 42 is spiral-shaped and forms a generally tangential particle outlet opening for particles leaving the cyclone. The particles leaving through the opening 41 have a direction component that is generally perpendicular to the axis of rotation R of the vortex created in the cyclone chamber 26.

The collecting container 27 is, with the exception of the previously-mentioned wall part 31 and cover plate 37, surrounded by an end wall 44, a bottom wall 45, and side walls 46. One side wall merges with the spiral-shaped wall 43 of the channel 42, as illustrated in FIG. 7. The bottom wall 45, at its external side, is provided with a locking shoulder 47, the function of which will be explained below.

The coarse separator 25, the cyclone chamber 26, and the collecting container 27 are each provided with a completely open end wall that is normally covered by the cover plate 37. The cover plate 37 is normally secured on the liner 14 and is removed when the collecting container 27 is to be emptied.

Figure 5:
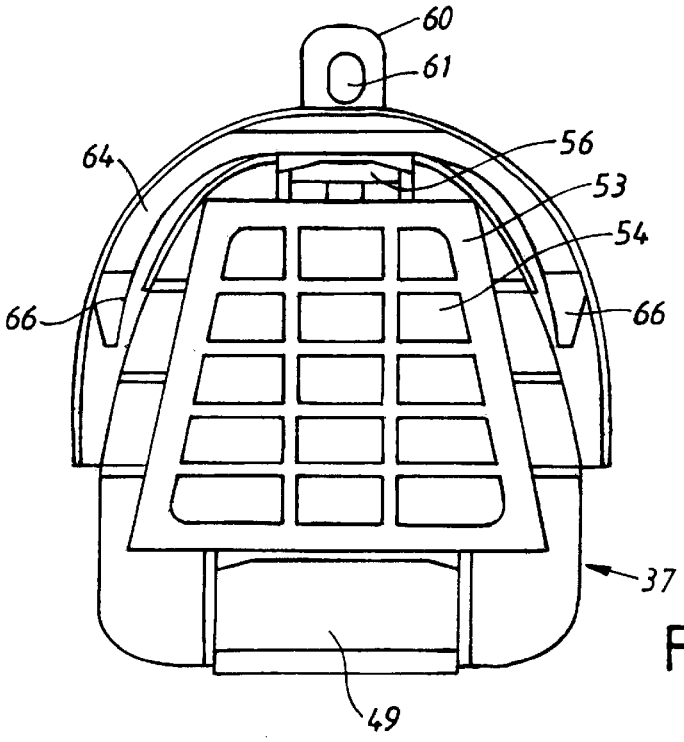
FIG. 5 is an end view of the liner as seen from the right hand side in FIG. 4, but with the cover plate secured to the liner.
Figure 8:
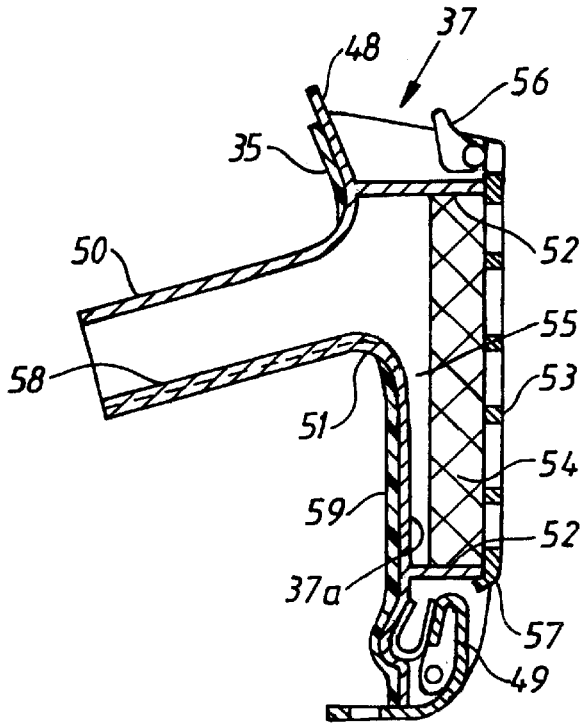
FIG. 8 is a vertical section through the cover plate.
Figure 9:
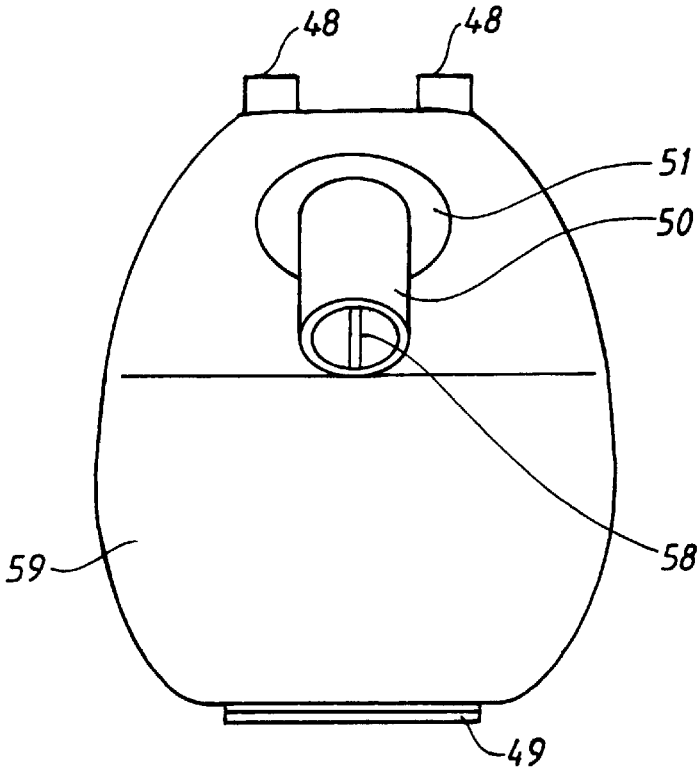
FIG. 9 is the cover plate in a front view from the left hand side in FIG. 8.

With reference to FIGS. 5, 8, and 9, the cover plate 37 includes an angled plate 37*a* having two lugs 48 and a spring-loaded latching hook 49. The lugs 48 are inserted into recesses (not shown) in the liner 14 whereas the latching hook 49 engages the locking shoulder 47 on the liner 14 in order to releasably lock the cover plate 37 to the liner 14.

The cover plate 37 also has a circular tube 50 extending from the angled plate 37*a*. The tube 50 is provided with a rounded portion 51 at one tube end interconnecting the tube 50 and the angled plate 37*a*. The cover plate 37 has, at the opposite side of the angled plate 37*a* relative to the tube 50, a wall portion 52 surrounding a filter cassette 53 that receives a so-called deep filter 54. The deep filter 54 is, for example, a thick, coarse filter that can be picked out from the cassette 53 and cleaned, for instance, in a dishwasher. The filter 54 is spaced from the angled plate 37*a*, thereby creating a space 55 for the distribution of air flowing through the tube 50 to the complete area of the filter 54. The filter cassette 53 is retained on the cover plate 37 by cooperation between a locking mechanism 56 on the cover plate 37 and lugs 57 arranged on the cassette.

In order to decrease the creation of noise, the tube 50 has, at its internal side, an axially-directed flange or rib 58 preventing the creation of a vortex within the tube 50. The angled plate 37*a* is, at the side from which the tube 50 extends, provided with a soft material layer 59 that serves as a sealing member when the cover plate 37 is secured to the liner 14.

With reference to FIGS. 4 and 6, the liner 14 includes a handle 60 that also serves as a handle for the complete vacuum cleaner. The handle 60 includes a knob or button 61 that is operable to release the liner 14 from the vacuum cleaner housing 10. The knob 61 is under the influence of a spring 62 and is, via an arm 63, connected to a yoke member 64. The yoke member 64 is supported for turning motion about shafts 65 arranged at each side of the liner 14. Each side of the yoke member 64 is provided with a hook 66 that engages a shoulder or the like (not shown) in the vacuum cleaner housing 10. The liner 14 is also provided with a holder 67 cooperating with, and partly surrounding, the end wall 22 of the vacuum cleaner housing 10.

In order to get proper particle separation conditions, the diameter of the cyclone chamber 26 is preferably within the range of 50–100 mm, the length of the cyclone is within the range of about 100–300 mm, and the distance between the opening 39 and the second end wall 36 is more than 20 mm. The length of the tube 50 is preferably 20–50% of the length of the cyclone.

The vacuum cleaner described above operates and is used in the following manner. Dust-laden air taken up by the vacuum cleaner nozzle 5 flows through the tube shaft 6 and the hose 8 into the tube section 23. The air flows via the inlet opening 29 into the coarse separator 25 and continues toward the end that is covered by the cover plate 37. Heavier particles are separated from the air flow in the coarse separator 25 because of the reduction of the air velocity and the air deflection at the opening 32. The separated particles are collected on the wall part 31 that serves as a bottom of the coarse separator 25. After deflection, the air flow continues through the opening 32 and further through the inlet channel 33 toward the cyclone chamber 26.

Air flows tangentially into the cyclone chamber 26 and near the first end wall 35 between the side wall of the cyclone chamber 26 and the tube 50, the tube 50 being indicated by dash-dotted lines in FIG. 4. This means that a vortex is created about the central axis of rotation R in the intermediate part 38 of the cyclone chamber 26. Due to centrifugal forces, dust particles are distributed toward the second end wall 36, pass through the opening 38, and into the separation part 40. The particles are thrown out mainly perpendicular to the rotational axis through the opening 41 and the channel 42 into the collecting container 27, which is placed outside the separation part 40, and collect on the bottom 45 of the collecting container 27.

The air at the central part of the vortex, which is substantially free of large particles, is drawn out via the tube 50 of the cover plate 37 and flows through the space 55 and the filter 54 in which further particles are separated. The air continues through the inlet part 17 and the openings 16 into the motor fan unit 15, and then leaves to atmosphere via the outlet filter 19 in which smaller particles are separated.

When the vacuum cleaner is emptied, the liner 14 is first removed from the vacuum cleaner housing 10 by depressing the knob 61 on the handle 60. Depressing the knob 61 causes the yoke member 64 to pivot about the shafts 65 such that the hook 66 disengages from the shoulder (not shown) in the vacuum cleaner housing 10. Thus, the liner 14 can be turned somewhat about the front part and then lifted out of the recess 13 in the vacuum cleaner housing 10. The cover plate 37 is then removed from the liner 14 by depressing the latching hook 49, which means that the plate 37 disengages from the locking shoulder 47 on the liner 14 to permit the cover plate to be tilted and the fastening lugs 48 drawn out from the recesses (not shown).

Turning the liner 14 up-side-down simultaneously empties all the material that was collected in the cavities, i.e. the collecting container 27, the coarse separator 26 and the cyclone chamber 25, into a bin or the like. The arrangement also allows all the cavities 25, 26, 27 to be easily cleaned since the end walls (cover plate 37) of the cavities are completely removed and, hence, all parts of the cavities are accessible without further disassembly or the need for special cleaning tools.

If necessary, the filter cassette 53 can be released from the cover plate 37 and then the filter 54 can be picked out and cleaned. After cleaning, the filter 54 and the filter cassette 53 are again secured to the cover plate 37. Then the cover plate 37 is fixed to the liner 14 which is placed in the recess 13 such that the filter cassette 53 abuts the inclined sealing plane 18. Application of additional pressure will then allow the hooks 66 to engage the shoulders (not shown) in the vacuum cleaner housing 10.

An optional emptying ring (not shown) may be used to facilitate emptying of the cavities 25, 26, 27. Such an emptying ring is shaped such that it corresponds to the part of the liner 14 on which the cover plate 37 is normally secured. The cover plate 37 is removed from the liner 14 and a conventional plastic bag is placed within the emptying ring. The open end of the bag is folded about the ring after which the emptying ring is manually pressed toward the liner. The liner 14 with the emptying ring and the bag is then turned up-side-down such that the dust falls down into the bag. The bag and the emptying ring can then be separated from the liner 14 and from one another after which the bag can be closed and thrown away.

While the preferred embodiment of the present invention is shown and described herein, it is to be understood that the same is not so limited but shall cover and include any and all modifications thereof which fall within the purview of the invention.

What is claimed is:

1. A vacuum cleaner comprising a vacuum cleaner housing (10) containing a coarse separator (25), a cyclone with a cyclone chamber (26), a collecting chamber (27), and a vacuum source (15) for drawing dust laden air into said coarse separator (25) from a nozzle (5) connected to the housing (10), said cyclone chamber (26) being arranged downstream from the coarse separator as seen in the flow direction, said collecting container (27) being arranged to collect particles separated by the cyclone, wherein the coarse separator (25), the cyclone chamber (26) and the collecting container (27) define a removable unit (14) that is adapted to be removed from and installed in the vacuum cleaner housing (10) and a removable cover plate defining a wall of each of the coarse separator (25), the cyclone chamber (26) and the collecting container (27), (37) such that removing said cover plate simultaneously uncovers the coarse separator, the cyclone and the collecting container so as to facilitate emptying the removable unit (14).

2. The vacuum cleaner according to claim 1, wherein the unit (14) is provided with a handle (60) that, when the unit is placed in the vacuum cleaner housing (10), also serves as a handle for the vacuum cleaner.

3. The vacuum cleaner according to claim 1, wherein the cyclone comprises a first end wall (35), a second end wall (36), an intermediate part (38), a mainly tangentially directed inlet (38) for dust laden air, and a separation unit (40), said intermediate part having a mainly cylindrical wall part, said inlet being disposed at a location close to the first end wall, said separation unit being disposed at a location close to the second end wall (36) and having an outlet (41) for dust and dirt particles, the cyclone also enclosing an outlet tube (50) for cleaned air, said outlet tube being connected to the cover plate.

4. The vacuum cleaner according to claim 3, wherein the outlet tube (50) is permanently connected to the cover plate (37).

5. The vacuum cleaner according to claim 3, wherein the outlet tube (50), at its connection to the cover plate (37), is provided with a rounded portion.

6. The vacuum cleaner according to claim 3, wherein the cover plate (37) defines an air distribution chamber (55) communicating with the outlet tube (50) and includes a removable filter (54), said filter (54) being placed adjacent the air distribution chamber.

7. The vacuum cleaner according to claim 6, wherein the filter (54) is made of a washable, porous material having a thickness exceeding 10 mm.

8. The vacuum cleaner according to claim 6, wherein the filter (54) is disposed in a removable cassette (53).

9. The vacuum cleaner according to claim 1 wherein the cover plate (37) and the vacuum cleaner housing (10) cooperate to define an inclined sealing plane (18) that is arranged such that, when an end of the unit (14) is being removed from the vacuum cleaner housing, a sealing surface of the cover plate simultaneously disengages from an associated sealing surface of the vacuum cleaner housing.

10. The vacuum cleaner according to claim 1, wherein the coarse separator (25), the cyclone, and the collecting container (27) are placed beside and parallel to one another, and wherein the wall (37) forms an end wall for the coarse separator, the collecting container, and the cyclone chamber.

* * * * *